US005781209A

United States Patent [19]

Yoshimura

[11] Patent Number: 5,781,209

[45] Date of Patent: Jul. 14, 1998

[54] METHOD OF PRODUCING AN INK EJECTING DEVICE

[75] Inventor: Manabu Yoshimura, Nagoya, Japan

[73] Assignee: Brother Kogyo Kabushiki Kaisha, Nagoya, Japan

[21] Appl. No.: 521,453

[22] Filed: Aug. 30, 1995

[30] Foreign Application Priority Data

Sep. 1, 1994 [JP] Japan ..... 6-208494

[51] Int. Cl.[6] ..... B41J 2/16

[52] U.S. Cl. ..... 347/45

[58] Field of Search ..... 347/45, 47

[56] References Cited

U.S. PATENT DOCUMENTS

| | | | |
|---|---|---|---|
| 3,946,298 | 3/1976 | van de Loo . | |
| 4,723,129 | 2/1988 | Endo et al. . | |
| 4,725,862 | 2/1988 | Matsuzaki . | |
| 5,148,193 | 9/1992 | Inamoto et al. | 347/45 |

FOREIGN PATENT DOCUMENTS

| | | |
|---|---|---|
| 59-182745 | 10/1984 | Japan . |
| 60-29457 | 2/1985 | Japan . |
| A-60-24957 | 2/1985 | Japan . |
| 63-22660 | 1/1988 | Japan . |

*Primary Examiner*—Valerie Lund
*Attorney, Agent, or Firm*—Oliff & Berridge, PLC

[57] ABSTRACT

A manifold is connected to a plurality of fluid chambers formed in the actuator plate of an ink jet printer head and nozzles formed in a nozzle plate are also connected thereto. A dye intermediate product layer is formed on the inner walls of the manifold, fluid chambers and nozzles. Because the inner walls of the manifold, fluid chambers and nozzles undergo parent inking through this dye intermediate product layer, air bubbles do not remain in the ink flow path, and the ink can be sprayed with a uniform spraying direction and a stable flight velocity.

26 Claims, 9 Drawing Sheets

Fig.3

| COMPOSITION | A | B | C |
|---|---|---|---|
| NITROBENZENE | 3 | – | – |
| TRONAPHTHALANE | – | 3 | – |
| PHENOL | – | – | 3 |
| ETHANOL | 5 | 5 | 5 |
| GLYCERIN | 2 | 2 | 2 |
| ION EXCHANGE WATER | 90 | 90 | 90 |

UNITS : % BY WEIGHT

ANGLE OF CONTACT ON POLYIMIDE AND EPOXY
( ROOM TEMPERATURE PROCESSING )

ANGLE OF CONTACT ON POLYIMIDE AND EPOXY
( 60 MINUTE PROCESS )

Fig.6A

| | PROCESSING TIME ( min ) | PROCESSING TEMPERATURE ( °C ) | INITIAL FILLING CAPACITY ＊1 | AIR BUBBLE ELIMINATION ＊2 |
|---|---|---|---|---|
| HEAD OF EMBODIMENT A | 3 | 20 | 4 | – |
| | 5 | | 0 | 2 |
| | 30 | | 0 | 1 |
| | 60 | 20 | 0 | 1 |
| | | 40 | 0 | 1 |
| | | 80 | 0 | 1 |
| HEAD OF EMBODIMENT B | 3 | 20 | 5 | – |
| | 5 | | 0 | 2 |
| | 30 | | 0 | 1 |
| | 60 | 20 | 0 | 1 |
| | | 40 | 0 | 1 |
| | | 80 | 0 | 1 |

＊1 ···· THE NUMBER OF NOZZLES THAT COULD NOT BE FILLED
＊2 ···· THE NUMBER OF TIMES SUCKING WITH THE PUMP HAD TO BE CONDUCTED IN ORDER TO ELIMINATE AIR BUBBLES

Fig.6B

| | PROCESSING TIME ( min ) | PROCESSING TEMPERATURE ( °C ) | INITIAL FILLING CAPACITY ✳ 1 | AIR BUBBLE ELIMINATION ✳ 2 |
|---|---|---|---|---|
| HEAD OF EMBODIMENT C | 3 | 20 | 4 | – |
| | 5 | | 0 | 2 |
| | 30 | | 0 | 1 |
| | 60 | 20 | 0 | 1 |
| | | 40 | 0 | 1 |
| | | 80 | 0 | 1 |
| HEAD OF COMPARISON EXAMPLE 1 | – | – | 7 | – |
| HEAD OF COMPARISON EXAMPLE 2 | 60 | 20 | 0 | 3 |
| | 60 | 80 | 25 | – |

✳ 1 ···· THE NUMBER OF NOZZLES THAT COULD NOT BE FILLED
✳ 2 ···· THE NUMBER OF TIMES SUCKING WITH THE PUMP HAD TO BE CONDUCTED IN ORDER TO ELIMINATE AIR BUBBLES

Fig.7A

| | PROCESSING TIME ( min ) | PROCESSING TEMPERATURE (°C) | CONTINUOUS INK SPRAYING TIME |
|---|---|---|---|
| HEAD OF EMBODIMENT A | 3 | 20 | 2.5 HOURS |
| | 5 | | 5.0 HOURS |
| | 30 | | 5.8 HOURS |
| | 60 | 20 | 6.5 HOURS |
| | | 40 | 6.8 HOURS |
| | | 80 | 7.0 HOURS |
| HEAD OF EMBODIMENT B | 3 | 20 | 2.2 HOURS |
| | 5 | | 4.8 HOURS |
| | 30 | | 5.5 HOURS |
| | 60 | 20 | 6.2 HOURS |
| | | 40 | 6.5 HOURS |
| | | 80 | 6.8 HOURS |

Fig.7B

| | PROCESSING TIME ( min ) | PROCESSING TEMPERATURE (°C) | CONTINUOUS INK SPRAYING TIME |
|---|---|---|---|
| HEAD OF EMBODIMENT C | 3 | 20 | 2.4 HOURS |
| | 5 | | 4.8 HOURS |
| | 30 | | 5.6 HOURS |
| | 60 | 20 | 6.3 HOURS |
| | | 40 | 6.6 HOURS |
| | | 80 | 6.9 HOURS |
| HEAD OF COMPARISON EXAMPLE 1 | – | – | 15 MINUTES |
| HEAD OF COMPARISON EXAMPLE 2 | 60 | 20 | 6.0 HOURS |
| | 60 | 80 | 1.0 HOURS |

Fig.8A

| | PROCESSING TIME ( min ) | PROCESSING TEMPERATURE ( °C ) | CHANGE IN ANGLE OF CONTACT ( deg. ) BETWEEN POLYIMIDE SUBSTRATE AND ION – EXCHANGE WATER | | | |
|---|---|---|---|---|---|---|
| | | | DAY 1 | DAY 3 | DAY 5 | DAY 7 |
| HEAD OF EMBODIMENT A | 3 | 20 | 57 | 60 | 63 | 65 |
| | 5 | | 42 | 43 | 45 | 44 |
| | 30 | | 41 | 42 | 45 | 44 |
| | 60 | 20 | 40 | 41 | 43 | 42 |
| | | 40 | 25 | 27 | 28 | 27 |
| | | 80 | 15 | 16 | 18 | 17 |
| HEAD OF EMBODIMENT B | 3 | 20 | 58 | 62 | 65 | 67 |
| | 5 | | 43 | 45 | 47 | 45 |
| | 30 | | 42 | 43 | 45 | 44 |
| | 60 | 20 | 42 | 43 | 44 | 43 |
| | | 40 | 26 | 27 | 30 | 28 |
| | | 80 | 18 | 19 | 20 | 20 |

Fig.8B

| | PROCESSING TIME ( min ) | PROCESSING TEMPERATURE ( °C ) | CHANGE IN ANGLE OF CONTACT ( deg. ) BETWEEN POLYIMIDE SUBSTRATE AND ION – EXCHANGE WATER | | | |
|---|---|---|---|---|---|---|
| | | | DAY 1 | DAY 3 | DAY 5 | DAY 7 |
| HEAD OF EMBODIMENT C | 3 | 20 | 57 | 60 | 64 | 66 |
| | 5 | | 43 | 45 | 47 | 45 |
| | 30 | | 41 | 42 | 45 | 43 |
| | 60 | 20 | 40 | 41 | 43 | 42 |
| | | 40 | 26 | 27 | 28 | 27 |
| | | 80 | 17 | 18 | 19 | 19 |
| HEAD OF COMPARISON EXAMPLE 1 | – | – | 72 | 73 | 72 | 71 |
| HEAD OF COMPARISON EXAMPLE 2 | 60 | 20 | 42 | 46 | 55 | 64 |
| | 60 | 80 | 25 | 37 | 42 | 50 |

METHOD OF PRODUCING AN INK EJECTING DEVICE

BACKGROUND OF THE INVENTION

1. Field of the Invention

The invention relates to a method for producing an ink ejecting device that conducts recording of characters and images using ink.

2. Description of Related Art

With conventional ink ejecting devices, various proposals have been known for improving the wettability (parent inking) between the ink and the surfaces of contact in the ink path, which includes the ink storage unit, the ink supply path and the head nozzle tip.

For example, as disclosed in U.S. Pat. No. 4,725,862 and in Japanese Unexamined Patent Publication Sho 60-24957, methods exist for ensuring that no air bubbles remain in the pressure chamber at the time of ink ejection from the ink storage unit and for easily eliminating air bubbles that are created by providing the surfaces of the plastic head, that contact the ink, to have glass-like properties through chemical liquid treatments, ultraviolet rays, plasma, corona discharges and flame treatment and the like. In addition, as disclosed in Japanese Unexamined Patent Publication Sho 63-22660, a method exists for creating a parent inking film by coating the nozzle tip surface with a silicone film using an ion plating method. In addition, as disclosed in Japanese Unexamined Patent Publication Sho 59-182745, a method exists for improving the wettability of the surface of contact by causing a dye solution to adhere to or permeate the surface of contact by adding heat when the dye solution and the surface of contact of the ink ejecting device are in contact with one another.

However, with the parent inking process for the surfaces of contact of the conventional ink ejecting devices, when the surface is caused to have the same properties as glass by a chemical liquid treatment and ultraviolet rays, and when the silicone film is formed by the ion plating method, the treatment processes for the inner wall surfaces of long, narrow tubes or for surfaces having a complex shape are difficult. In addition, devices in which the surface is caused to have the same properties as glass by a chemical liquid treatment and ultraviolet rays, or devices in which a silicone film is formed by the ion plating method are expensive.

Further, with the method wherein a dye solution is caused to adhere to or permeate the surface of contact through adding heat when the dye solution and the surface of contact of the ink ejecting device are in contact with each other, the adherence of the dye occurring because the dye solution is heated, has a negative effect on ink ejection as it causes the interior of the ink flow path of the ink jet device and the cross-sectional shape of the nozzle unit to change. Furthermore, in the worst cases, the problem arises that the ink flow path or the nozzle unit becomes closed. In addition, because a dye solution is used, when the processing liquid adheres to a location other than the ink flow path at the time of processing, such as to the external portions, the device is unnecessarily colored because the dye is difficult to remove, causing the external appearance to deteriorate. Lastly, the dye is expensive.

SUMMARY OF THE INVENTION

In consideration of the foregoing, an object of the invention is to provide a method for producing an ink ejecting device in which an inexpensive parent inking process is possible without causing the ink flow path of the nozzle unit to be closed.

In order to achieve this and other objectives, the invention is a method of producing an ink ejecting device which accomplishes recording of characters and images using ink, wherein a solution including a dye intermediate product and the surface of contact of the ink flow path are caused to contact each other, the dye intermediate product being caused to adhere to or to permeate the surface of contact with the ink flow path.

With the method of producing an ink jet device according to the invention and having the composition described above, a solution including a dye intermediate product and the surface of contact of the ink flow path are caused to come into contact each other, by which means the dye intermediate product is caused to adhere to or permeate the surface of contact with the ink flow path, thereby causing the surface of contact to be parent inked. Consequently, it is possible to eject ink droplets with a uniform ejecting direction and a stable flight velocity without air bubbles remaining inside the ink flow path.

BRIEF DESCRIPTION OF THE DRAWINGS

A preferred embodiment of the invention is described in detail hereafter, with reference to the following figures, wherein:

FIG. 3 is a drawing used to explain the composition of the dye intermediate product solution according to the preferred embodiment;

FIGS. 6A and 6B are a table relating to the initial filling and air bubble elimination of the parent inking process of the preferred embodiment and the parent inking process of comparison examples;

FIGS. 7A and 7B are a table showing the stable ejecting time interval of the parent inking process of the preferred embodiment and the parent inking process of comparison examples; and FIGS. 8A and 8B are a table showing the durability of parent inking of the parent inking process of the preferred embodiment and the parent inking process of comparison examples.

DETAILED DESCRIPTION OF PREFERRED EMBODIMENT

Figure 1:
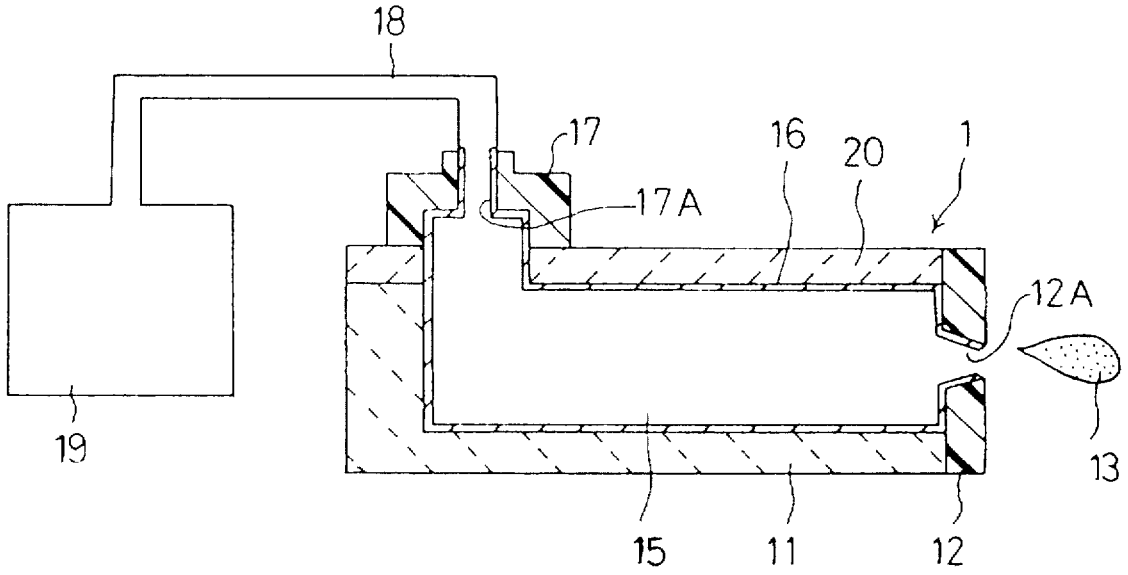
FIG. 1 is a cross-sectional diagram showing the ink ejecting device according to the preferred embodiment.
Figure 2:
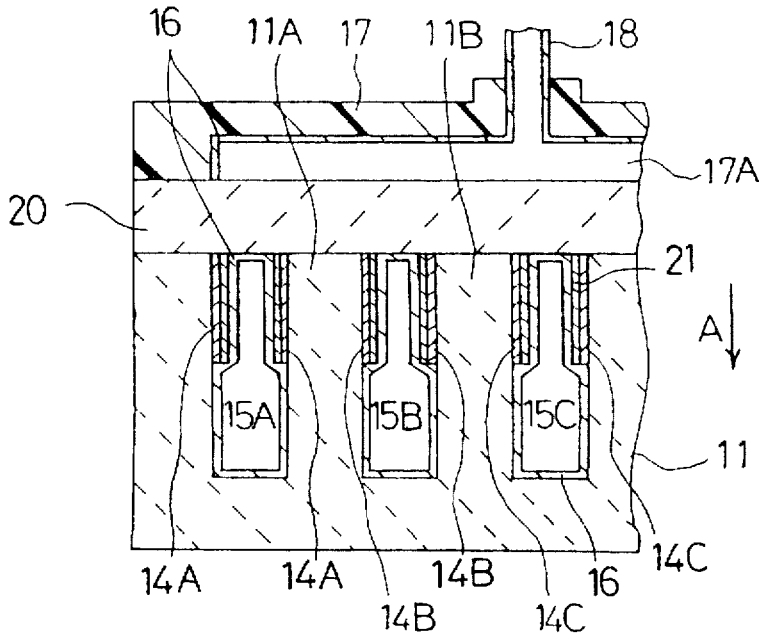
FIG. 2 is a cross-sectional diagram showing the ink ejecting device according to the preferred embodiment.

FIGS. 1 and 2 show the ink ejecting device of the invention. The ink in the ink storage unit 19 fills the fluid chambers 15 and the nozzles 12A by passing through the manifold 17A of the head 1 via the ink supply path 18. The head 1 comprises a cover plate 20, a manifold member 17 and an actuator plate 11 that is formed of piezoelectric ceramics (lead zirconate titanate).

As shown in FIG. 2, the actuator plate 11 is formed of a plurality of grooves polarized in the direction indicated by the arrow A. Fluid chambers 15A–15C (the number of chambers shown is an example only) are formed by covering the grooves with the cover plate 20 that is also made of a ceramic material. Openings that connect to each of the fluid chambers 15 are formed in the cover plate 20 and the manifold member 17 is attached so that the manifold 17A covers the openings. In addition, nozzles 12A are formed in a nozzle plate 12, which in turn is formed of a polyimide, with a nozzle 12A connected to each fluid chamber 15. Electrodes 14A–14C (only three electrodes are shown in the example but the invention is not limited to the shown number of fluid chambers and electrodes) are respectively formed on the upper half of the side surface of each of the grooves formed in the actuator plate 11. A protective film 21 is formed of an epoxy resin on the inner walls of the fluid chambers in order to protect the electrodes 14 from the ink. Furthermore, a dye intermediate product layer 16 is formed on the inner wall surfaces of the manifold 17A and the fluid chambers 15, including on the protective film 21.

Next, the actions of a head 1 having this type of structure will be described. When electrodes 14A,14C are grounded while a pulse wave voltage is provided to electrode 14B, a piezoelectric lateral deformation occurs in such a way that the walls 11A,11B of the actuator plate 11 become farther apart so that ink is supplied to the fluid chamber 15B. When the provision of the voltage is stopped, after a predetermined time interval has elapsed, the walls 11A,11B return to their original state. Pressure is thereby applied to the ink in the fluid chamber 15B and an ink droplet 13 is ejected from the nozzle 12A.

Next, the method of forming the dye intermediate product layer 16 on the inner walls of the manifold 17A, the fluid chambers 15 and the nozzles 12A will be described.

A solution containing the dye intermediate product fills the inside of the head 1, that is to say, the manifold 17A, the fluid chambers 15 and the nozzles 12A. The dye intermediate product is then caused to adhere to or permeate the inner walls of the head 1 by being heated, by which means the dye intermediate product layer 16 is formed. For the solution containing the dye intermediate product, either a water-soluble or an oil-soluble solution may be used. In addition, it is possible by adding other components to use as the dye intermediate product any type of dye intermediate product so long as this does not contain any precipitate components.

The dye intermediate product is produced by applying, either once or a plurality of times, a unit chemical reaction, such as coupling or condensing and sulfonic permutation, halogen permutation, amino permutation (reduction or ammonolysis), oxidation, alkali fusion or diazitozation to aromatic compounds, such as benzene, toluene, xylene, naphthalene, or anthracene; heterocyclic compounds, such as carbazole or pyridine; using sulfuric acid, nitric acid, hydrochloric acid, bromine, iodine, caustic potash, ammonia, chromic acid, or oxygen (air). The dye intermediate product has properties different from that of dye. A dye is a product obtained by causing a dye intermediate product to chemically react several times or several dozen times, and consequently has properties different from those of a dye intermediate product and is a product which does not entirely contain a dye intermediate product.

As a dye intermediate product, there are, for example, benzene and toluene-based intermediate products, naphthalene-based intermediate products and anthraquinone-based intermediate products.

Examples of benzene and toluene-based dye intermediate products include: nitrobenzene, m-dinitrobenzene, nitrotoluenes (for example, 4-nitrotoluene-2-sulfonic acid), chloronitrobenzenes (for example, 1-chloro-2,4-dinitrobenzene), nitrophenols (for example, 2,4-dinitrophenol), nitroanisoles, nitrophenetoles, nitroanilines, aniline, N-methylanilines (for example, P-nitroso-N,N-dimethylaniline or P-amino-N,N-dimethylaniline), phenylene diamines (for example, m-phenylene diamine or P-phenylene diamine), diphenyl amine, P-nitrosodiphenylamine, P-amino diphenylamine, benzidines (for example, O-tolidine, O-dianisidine, or 3,3'-dichlorobenzidine), toluidines, chlorotoluidines, nitrotoluidines, xylidines, chloroanilines, aminophenols (for example, O-aminophenol, m-dimethyl aminophenol, m-diethyl aminophenol, or P-aminophenol), chlorobenzene, benzoyl chloride, phenol, chlorophenols, benzoquinone, hydroquinone, resorcinol, benzenesulfonic acid, metanilic acid (m-amino benzenesulfonic acid), and sulfonilic acid (P-ammonobenzenesulfonic acid).

In addition, examples of naphthalene-based dye intermediate products include: α-nitronaphthalene, α-naphthylamine, β-naphthylamine, β-naphthalenesulfonic acid, naphthalenedisulfonic acid, naphthalenetrisulfonic acid, naphthols (α-naphthol, β-naphthol, 2-hydroxy-3-naphthoic acid), peri acid (1-naphthylamine-8-sulfonic acid), naphthionic acid, Cleve acid, Freund acid, Koch acid (1-naphthylamine-3,6,8-trisulfonic acid), (Tobias-phonetic) acid (2-naphthylamine-1-sulfonic acid), NW acid (1-naphthol-4-sulfonic acid), G acid (2-naphthol-6,8-disulfonic acid), R acid (2-naphthol-3,6-disulfonic acid), SS acid (8-amino-1-naphthol-5,7-disulfonic acid), K acid (8-amino-1-naphthol-3,5-disulfonic acid), H acid (8-amino-1-naphthol-3,6-disulfonic acid), J acid (6-amino-1-naphthol-3-sulfonic acid), γ-acid (7-amino-1-naphthol-3-sulfonic acid), carbonyl J acid, N-phenyl J acid, N-phenyl γ-acid and anhydrous phthalic acid.

Furthermore, as anthraquinone-based dye intermediate products, anthraquinone, 2-chloroanthraquinone, 1,5-dinitroanthraquinone, anthraquinone-α-sulfonic acid, anthraquinone-β-sulfonic acid, 1-aminoanthraquinone, 2-aminoanthraquinone, 1,4-dihydroxyanthraquinone, and benzanthrone may be used.

The above-described examples of dye intermediate products are those that are particularly preferable for the dye intermediate product solutions of the invention, but the dye intermediate product of the dye intermediate product solution used in the invention is not limited to the identified dye intermediate products.

In addition, the solvents suitable for use in the dye intermediate product solutions employed in the invention are solvents that are mixtures of ion-exchange water having five ppm or less of Ca ions and Mg ions and water-soluble organic solvents. Alkyl alcohols with one to four carbon atoms, ketone or ketone alcohols, ethers, polyalkylene glycols, alkylene glycols with alkylene radicals including 2–6 carbon atoms, glycerin, low-grade alkyl ether polyhydric alcohol, N-methyl-2-pyridine, 1-3-dimethyl-2-imidazolidinone, triethanolamine and ethylene glycol may be used, but this is intended to be illustrative and not limiting.

The basic composition used in the dye intermediate product solutions of the preferred embodiment are as described above, but it is possible to add, as necessary, conventionally known surfactants, viscosity regulating agents, surface tension regulating agents, resistivity regulating agents, pH regulating agents (for example, sodium hydroxide, lithium hydroxide, or potassium hydroxide), anti-mold agents, penetrating agents (methanol, ethanol, or propanol) and chelating agents.

The conditions under which the dye intermediate product layer 16 is formed in the fluid chambers 15 of the above-described head 1 were changed and the dye intermediate product layer 16 that was formed was evaluated. The inside of the head 1, in which a protective layer was formed of epoxy resin on the inner walls of the fluid chambers 15, was cleaned and dried. Following this, the dye intermediate production solutions obtained using the percentages by weight of the components for A through C listed in the table shown in FIG. 3 were supplied into the head using a sucking pump. Following this, dye intermediate product layers were obtained for each of the product conditions by changing the process time interval up to 24 hours from the product obtained by causing instantaneous contact under various temperature conditions including room temperature. Measuring the angle of contact between the ink and the dye intermediate product layer 16 formed in the fluid chambers 15 and the nozzles 12A was difficult because the fluid chambers 15 and nozzles 12A are extremely small. Consequently, a dye intermediate product layer was formed on an epoxy plate and a polyimide plate under the same conditions as the process conditions described above, and the angle of contact with the ink was then measured.

Evaluations 1 through 4 below were conducted using the head 1 and the epoxy and polyimide plates, and the efficacy of each parent inking process with the dye intermediate product layer was verified.

EVALUATION 1

Figure 4:
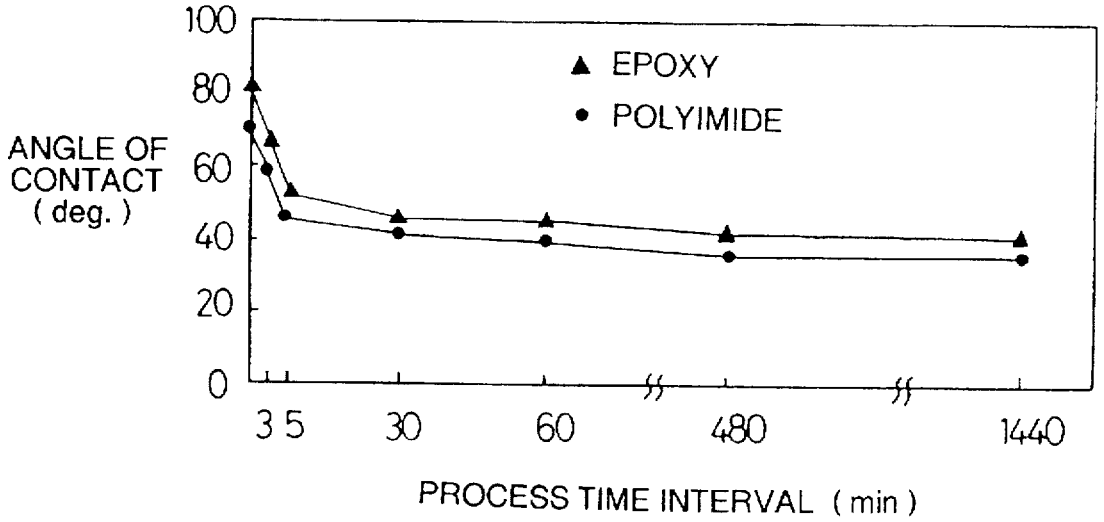
FIG. 4 is an explanatory drawing showing the relationship between the parent inking process time and the angle of contact in the preferred embodiment.
Figure 5:
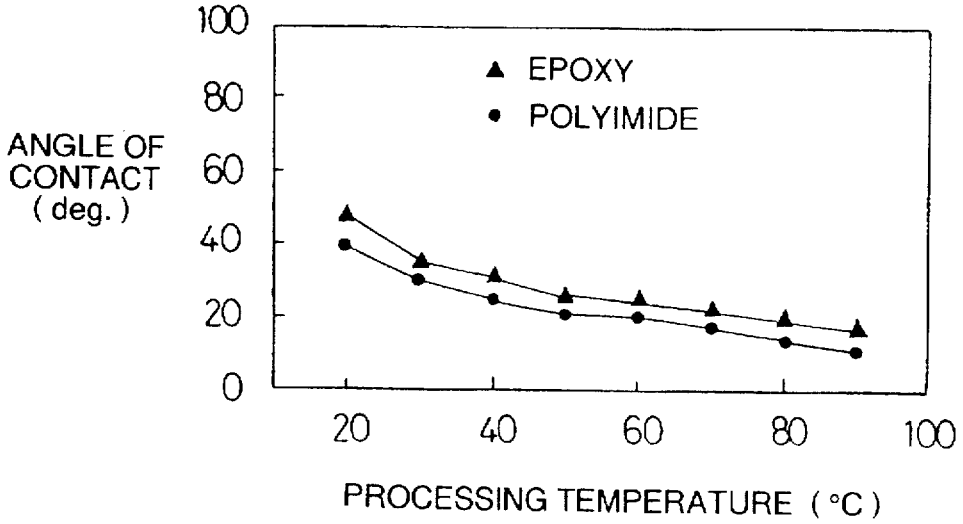
FIG. 5 is an explanatory drawing showing the relationship between the parent inking process time and the angle of contact in the preferred embodiment.

Ion-exchange water was dropped onto the individual plates of epoxy and polyimide on which the dye intermediate product layer was formed by the dye intermediate product solution of A shown in FIG. 3, and the angle of contact was measured. The results are shown in FIGS. 4 and 5. From these results, it can be seen that parent inking occurred with a smaller angle of contact with the ion-exchange water the longer the process time and the higher the process temperature. In addition, as shown in FIG. 4, the change in the angle of contact is large when the process time is less than five minutes, while the change in the angle of contact is small when the process time is five minutes or more. In addition, when the process time is less than five minutes, the angle of contact with the ion-exchange water is large, while when the process time is five minutes or more, the angle of contact with the ion exchange water is smaller.

Consequently, it is preferable to have a process time of five minutes or more, with higher process temperatures also being preferable. However, the desirable temperature range is room temperature (around 20° C.) to 100° C. Results indicating similar trends were also obtained with individual plates of epoxy and polyimide on which the dye intermediate product layer was formed by the dye intermediate product solutions B and C as shown in FIG. 3.

EVALUATION 2

The ink in the ink storage unit 19 was sucked from the nozzle side by a sucking pump (not shown). Observations were made of the initial filling capabilities by causing the ink to fill the manifold 17A, the fluid chambers 15 and the nozzles 12A, using heads in which the dye intermediate product layer was formed using the dye intermediate product solutions A through C and heads of comparison examples 1 and 2 described below. The items of observation consisted of counting the number of nozzles 12A which were not filled following sucking of the ink and comparing the numbers. Furthermore, air bubbles were intentionally created in the fluid chambers 15 of the head 1. The ink was sucked using the sucking pump at a rate of approximately 0.01 cc per time. Then the number of times the sucking had to be repeated in order to eliminate the air bubbles was compared. Because the ink flow within the ink flow path is smoother the better the affinity with the ink, the number of nozzles that could not be filled is smaller and the number of times the sucking must be repeated in order to eliminate the air bubbles is also smaller in the heads of the invention.

The ink composition used in the initial evaluation of filling capability and air bubble elimination is noted hereafter. INK:

| | |
|---|---|
| Dye: C.I.direct black 154 | 2% |
| ethanol | 5% |
| glycerin | 4% |
| ion-exchange water | 89% |

In addition, the head of comparison example 1 is a head 1 wherein the inside was cleaned with ion-exchange water, but there was no intermediate dye product layer 16 therein. The head of comparison example 2 is a head 1 wherein the inside was cleaned with ion-exchange water, following which a heating process is conducted in order to cause contact between the dye solution and the surface of contact similar to the conventional art. Ink having the above-described composition was used as the dye solution employed in the process.

As shown in FIGS. 6A and 6B, with the heads 1 of embodiments A through C, that is, heads treated with dye intermediate product solutions A through C respectively, the devices produced with a process time interval of three minutes had a small number of nozzles that could not be filled during the initial filling, and air bubble elimination could not be accomplished despite driving the sucking pump 20 times. In addition, devices produced with process time intervals greater than three minutes yielded results wherein all of the nozzles could be filled, and the sucking pump needed to be driven only once or twice.

With the head of comparison example 1, a small number of nozzles could not be filled during the initial filling, and air bubble elimination could not be accomplished despite driving the sucking pump 20 times. With the head of comparison example 2, the device produced with a processing temperature of 20° C. yielded results wherein all of the nozzles could be filled, and the sucking pump needed to be driven only three times, but the device produced with a processing temperature of 80° C. yielded results wherein the dye accumulated in the fluid chambers and inside the nozzles, restricting the ink flow path, so that around half of the nozzles could not be filled and air bubble elimination could not be accomplished despite driving the sucking pump 20 times.

From these results, it can be seen that it is possible to obtain good initial filling and to conduct good air bubble elimination with heads wherein the dye intermediate product layer is formed under conditions that include a processing time of five minutes or more.

EVALUATION 3

Next, an ink ejecting evaluation was conducted using the heads 1 of embodiments A through C and the heads 1 of comparison examples 1 and 2. The driving conditions were an applied voltage of 30 V and a frequency of 5 Khz and the time interval over which stable ejecting occurred was measured. The results are shown in FIGS. 7A and 7B.

As shown in FIGS. 7A and 7B, with the head 1 of comparison example 1, the time interval over which stable spraying occurred was considerably less than that of the other heads. In addition, the head 1 of comparison example 2, produced with a processing temperature of 80° C. and a processing time of 60 minutes, yielded a shorter stable spraying time interval than the comparable heads 1 of embodiments A through C which were produced under the same conditions. As a result of disassembling the heads 1 and examining each, it was determined that this phenomenon was caused by the dye accumulating in the fluid chambers and inside the nozzles, thereby restricting the ink flow path.

From these results, it can be seen that heads 1 in which the dye intermediate product layers are formed according to the invention are capable of stable ejecting over long periods of time. In particular, heads produced with a processing time of five minutes or more have long stable ejecting times.

EVALUATION 4

From the results of evaluations 1 through 3, it was verified that parent inking was improved by causing a dye intermediate product layer 16 to be formed on the inner walls of the head 1. In order to verify the durability of these results, the angle of contact of the ion-exchange water on the single plate of polyimide in evaluation 1 was measured, following which the plate itself was placed in an isothermic tank at 60° C., and the angle of contact with the ion-exchange water was measured every other day. The measurement results are shown in FIGS. 8A and 8B.

From the results in FIGS. 8A and 8B, it was verified that with the plates of embodiments A through C, the initial angle of contact changed little so that the durability was excellent. In particular, plates produced with a processing time of five minutes or more had exceptional durability. The plate of comparison example 1 had poor wettability because no parent inking process could be conducted. The plate of comparison example 2 showed a change in the angle of contact in comparison with the plates of embodiments A through C which were produced under the same conditions, so that it was seen that there were problems with durability.

From the results of the above-described evaluations 1 through 4, it can be seen that when a dye intermediate product layer is caused to adhere to or permeate beforehand the surface of contact with the ink, the surface of contact undergoes parent inking, and a difference is created between this and unprocessed surfaces. Consequently, initial filling capabilities, air bubble elimination and continuous ink spraying time are improved, and the durability of these effects is also excellent.

As is clear from the above description, because a solution containing a dye intermediate product and the surface of contact of ink flow path are caused to contact each other with the above-described method of producing an ink ejecting device, the dye intermediate product is caused to adhere to or permeate the surface of contact of the ink flow path so that the surface of contact undergoes parent inking. Consequently, air bubbles that come from the manifold at the time of ink filling do not remain in the ink flow path and the ink droplets can be ejected in a uniform ejecting direction and with a stable flight velocity. In addition, initial filling of the ink into the ink flow path can be conducted favorably, and air bubbles created in the ink flow path can be eliminated with ease. Accordingly, it is possible to insure long-term reliability of the ink ejecting device. Furthermore, because the dye intermediate product can be removed with ease if the product adheres to the outside of the ink jet device during processing, the external appearance of the device is not harmed. In addition, because accumulation of the dye intermediate product does not occur, even under high temperatures for extended periods of time, as is the case with dye, the ink flow path and nozzles are not restricted or closed. Furthermore, because the price is less than that of dye, it is possible to reduce the cost of the parent inking process.

The above-described embodiment is intended to be illustrative and not limiting, and it is evident that many alternatives, modifications and variations will be apparent to those skilled in the art, and such are also included in the scope of the invention. For example, with the embodiment, the dye intermediate product layer 16 was formed after the head 1 had been assembled, but it would also be acceptable for the head to be assembled after the dye intermediate product layer has been formed on each of the individual components.

In addition, with the embodiment, the dye intermediate product layer was formed on a head of piezoelectric lateral deformation type, but similar results can also be obtained if a dye intermediate product layer is formed on a head of the Kyser type, such as disclosed in U.S. Pat. No. 3,946,298, or on a head of the thermal jet type, such as disclosed in U.S. Pat. No. 4,723,129.

What is claimed is:

1. A method of producing an ink ejecting device made of ceramic material which accomplishes recording of characters and images using ink ejected from at least one ink flow path, said method comprising steps of:

causing contact between surfaces of the ink flow path and a fluid containing an organic compound based dye intermediate product; and causing the dye intermediate product to adhere to or permeate the surfaces of the ink flow path.

2. The method for producing an ink jet device according to claim 1, wherein the length of time that the fluid containing the dye intermediate product and the surfaces of the ink flow path are in contact is greater than five minutes.

3. The method for producing an ink jet device according to claim 1, further comprising a step of applying heat when the fluid containing the dye intermediate product and the surfaces of the ink flow path are in contact.

4. The method according to claim 1, further comprising the step of selecting the organic compound based dye intermediate product from a group consisting of benzene based dye intermediate products, toluene based dye intermediate products, naphthalene based intermediate product and anthraquinome based dye intermediate products.

5. A printhead having a manifold, a cover, a base plate and a nozzle plate with a plurality of ink chambers contained therein, each ink chamber formed of a groove in the base plate and enclosed by the cover and the nozzle plate, a nozzle in the nozzle plate associated with each ink chamber and an opening in the cover associated with each ink chamber, the openings connecting the manifold with the ink chambers, produced by the method comprising the steps of:

contacting a surface of the manifold, surfaces of the base plate grooves, a surface of the nozzle plate, and interior surfaces of the nozzles and a surface of the cover with a fluid containing an organic compound based dye intermediate product; and causing the dye intermediate product to adhere to or permeate the contacted surfaces; and assembling the base plate, the cover, the manifold and the nozzle plate to form the printhead and define the plurality of ink chambers, wherein all printhead surfaces along an ink flow path have the dye intermediate product adhered thereto or permeated therein.

6. The printhead according to claim 5, wherein the organic compound based dye intermediate product is selected from a group consisting of benzene based dye intermediate products, toluene based dye intermediate products, naphthalene based dye intermediate products, and anthraquinone based dye intermediate products.

7. A printhead for an ink ejecting printer, comprising:

a base plate having a plurality of grooves therein, each said groove defined by a pair of opposing walls;

a cover mounted to an upper surface of said walls to create an ink chamber from each covered groove, said cover having an opening therethrough into each covered groove;

a manifold mounted to said cover and connecting to each opening;

a nozzle plate mounted to one end of said base plate and said cover, said nozzle plate having a nozzle opening into each ink chamber; and an organic compound based ink dye intermediate product parent inked on surfaces of each said nozzle, each said ink chamber, each said opening, and a surface of said manifold facing said openings.

8. The printhead according to claim 7, wherein the organic compound based dye intermediate product is selected from a group consisting of benzene based dye intermediate products, toluene based dye intermediate products, naphthalene based dye intermediate products, and anthraquinone based dye intermediate products.

9. A method for producing an ink ejecting printhead, comprising the steps of:

contacting a first surface of a manifold, an inner surface of a cover, groove surfaces of grooves formed in a base-plate and an inner surface of a nozzle plate, the nozzle plate having a plurality of nozzles, and an inner surface of each nozzle with a fluid containing an organic compound based dye intermediate product;

causing the dye intermediate product to adhere to or permeate the surfaces contacted; and forming a printhead of the manifold, cover, base-plate and nozzle plate with all surfaces facing an ink flow path having adhered thereto or permeated therein the dye intermediate product.

10. The method according to claim 9, further comprising the step of selecting the organic compound based dye intermediate product from a group consisting of benzene based dye intermediate products, toluene based dye intermediate products, naphthalene based intermediate product and anthraquinome based dye intermediate products.

11. A printhead, having a manifold with interior surfaces, a cover, a base plate and a nozzle plate with a plurality of ink chambers contained therein, each ink chamber formed of a groove in the base plate and enclosed by the cover and the nozzle plate to define interior surfaces, a nozzle in the nozzle plate associated with each ink chamber and an opening in the cover associated with each ink chamber, the openings connecting the manifold with the ink chambers, produced by a method comprising the steps of:

assembling the base plate, the cover, the manifold and the nozzle plate to form the printhead;

contacting the interior surfaces of the plurality of ink chambers and each nozzle of the nozzle plate with a fluid containing an organic compound based dye intermediate product; and causing the dye intermediate product to adhere to or permeate the interior surfaces of the ink chambers and of each nozzle.

12. The printhead produced by the method according to claim 11, wherein the ink intermediate product is also contacted with the interior surfaces of the manifold and surfaces of each opening in the cover to adhere or permeate the surfaces.

13. The printhead produced by the method according to claim 11, wherein said assembling step occurs prior to said contacting step.

14. The printhead produced by the method according to claim 11, wherein said contacting step is greater than five minutes.

15. The printhead produced by the method according to claim 11, further comprising the step of applying heat during said contacting step.

16. The printhead produced by the method according to claim 15, wherein during said step of applying heat, a temperature of applied heat is in a range of 20°–100° C. (68°–212° F.).

17. The printhead according to claim 11, wherein the organic compound based dye intermediate product is selected from a group consisting of benzene based dye intermediate products, toluene based dye intermediate products, naphthalene based dye intermediate products, and anthraquinone based dye intermediate products.

18. A method for producing an ink ejecting printhead, comprising the steps of:

forming a printhead having a manifold having interior surfaces, a cover, a base-plate and a nozzle plate with a plurality of ink chambers contained therein, each ink chamber having interior surfaces formed of a groove in the base plate enclosed by the cover and the nozzle plate, a nozzle in the nozzle plate having an inner surface associated with each ink chamber and an opening in the cover associated with each ink chamber, the openings connecting the manifold with the ink chambers;

contacting the interior surfaces of the plurality of ink chambers and the inner surface of each nozzle of the nozzle plate with a fluid containing an organic compound based dye intermediate product; and causing the dye intermediate product to adhere to or permeate the interior surfaces of the ink chambers and the inner surface of each nozzle.

19. The method according to claim 18, wherein the dye intermediate product is also contacted with the interior surfaces of the manifold and surfaces of each opening in the cover to adhere or permeate the surfaces.

20. The method according to claim 18, wherein said forming step occurs prior to said contacting step.

21. The method according to claim 18, wherein said contacting step is greater than five minutes.

22. The method according to claim 18, further comprising the step of selecting the organic compound based dye intermediate product from a group consisting of benzene based dye intermediate products, toluene based dye intermediate products, naphthalene based intermediate product and anthraquinome based dye intermediate products.

23. The method according to claim 18, further comprising the step of applying heat during said contacting step.

24. The method according to claim 23, wherein during said step of applying heat, a temperature of applied heat is in a range of 20°–100° C. (68°–212° F.).

25. The method for producing an ink ejecting printer according to claim 18, further comprising the step of introducing the fluid including the dye intermediate product through the manifold into the plurality of ink chambers.

26. The method for producing an ink ejecting printer according to claim 25, further comprising the step of removing the fluid from the manifold and the plurality of ink chambers through the nozzles by suction.

* * * * *